US011330886B2

(12) United States Patent
Ly

(10) Patent No.: US 11,330,886 B2
(45) Date of Patent: May 17, 2022

(54) GEL POLISH CURING ASSEMBLY

(71) Applicant: Hung Ly, Montgomery, AL (US)

(72) Inventor: Hung Ly, Montgomery, AL (US)

( * ) Notice: Subject to any disclaimer, the term of this patent is extended or adjusted under 35 U.S.C. 154(b) by 99 days.

(21) Appl. No.: 16/916,999

(22) Filed: Jun. 30, 2020

(65) Prior Publication Data

US 2021/0401146 A1 Dec. 30, 2021

(51) Int. Cl.

*A45D 29/18* (2006.01)
*F26B 9/00* (2006.01)
*A45D 29/22* (2006.01)

(52) U.S. Cl.

CPC ..... *A45D 29/18* (2013.01); *A45D 29/22* (2013.01); *F26B 9/003* (2013.01); *A45D 2200/205* (2013.01)

(58) Field of Classification Search

CPC .. A45D 29/18; A45D 29/22; A45D 2200/205; F26B 9/003
USPC ..... 34/523
See application file for complete search history.

(56) References Cited

U.S. PATENT DOCUMENTS 4,731,541 A * 3/1988 Shoemaker ..... A45D 29/18 250/455.11
5,130,551 A * 7/1992 Nafziger ..... A61Q 3/02 250/492.1
5,249,367 A 10/1993 Nafziger
6,762,425 B1 * 7/2004 Strait ..... A45D 29/00 250/455.11
7,100,620 B2 9/2006 Fung
D532,931 S 11/2006 Chang
7,712,473 B1 5/2010 Robinson
8,242,475 B1 8/2012 Cheng
8,312,641 B2 * 11/2012 Li ..... F26B 9/003 34/277
8,835,886 B2 9/2014 Vu
9,072,357 B2 * 7/2015 Li ..... A45D 29/00
9,707,537 B2 * 7/2017 Haile ..... A45D 29/00
9,855,543 B2 * 1/2018 Haile ..... B01J 19/123
10,172,430 B2 * 1/2019 Hsieh ..... H05B 47/19
10,247,475 B2 * 4/2019 Valia ..... A45D 29/00
10,506,861 B1 * 12/2019 Ma ..... A45D 29/18
10,876,791 B2 * 12/2020 Valia ..... A45D 29/00
2008/0289644 A1 11/2008 Bernecker
2012/0187311 A1 * 7/2012 Vu ..... A45D 29/00 250/492.1
2015/0082654 A1 3/2015 Jaegal
2015/0367317 A1 * 12/2015 Hwang ..... A45D 29/00 250/492.1

(Continued)

FOREIGN PATENT DOCUMENTS

JP 5435092 B1 * 3/2014 ..... F26B 3/28
JP 2014039780 A * 3/2014 ..... A45D 29/00
WO WO-2014030291 A * 2/2014 ..... F26B 3/28

*Primary Examiner* — Stephen M Gravini

(57) ABSTRACT

A gel polish curing assembly includes a housing that has a top wall, a bottom wall and a perimeter wall extending between the top and bottom walls. The perimeter wall includes a back wall, a first lateral wall and a second lateral wall. A front side of the housing is open. A plurality of light emitters is mounted within the housing. At least some of the light emitters are positioned on a bottom side of the top wall and are directed downwardly toward the bottom wall. The light emitters emits light having a wavelength that is between 340 and 380 nanometers.

7 Claims, 5 Drawing Sheets

(56) References Cited

U.S. PATENT DOCUMENTS

| | | | | |
|---|---|---|---|---|
| 2020/0022476 | A1* | 1/2020 | Gregory | A45D 29/22 |
| 2020/0237071 | A1* | 7/2020 | Lee | A45D 29/00 |

* cited by examiner

GEL POLISH CURING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to polish curing device and more particularly pertains to a new polish curing device for PURPOSE.

(2) Description of Related Art Including Information Disclosed Under 37 CFR 1.97 and 1.98

The prior art relates to polish curing device.

BRIEF SUMMARY OF THE INVENTION

An embodiment of the disclosure meets the needs presented above by generally comprising a housing that has a top wall, a bottom wall and a perimeter wall extending between the top and bottom walls. The perimeter wall includes a back wall, a first lateral wall and a second lateral wall. A front side of the housing is open. A plurality of light emitters is mounted within the housing. At least some of the light emitters are positioned on a bottom side of the top wall and are directed downwardly toward the bottom wall. The light emitters emits light having a wavelength that is between 340 and 380 nanometers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
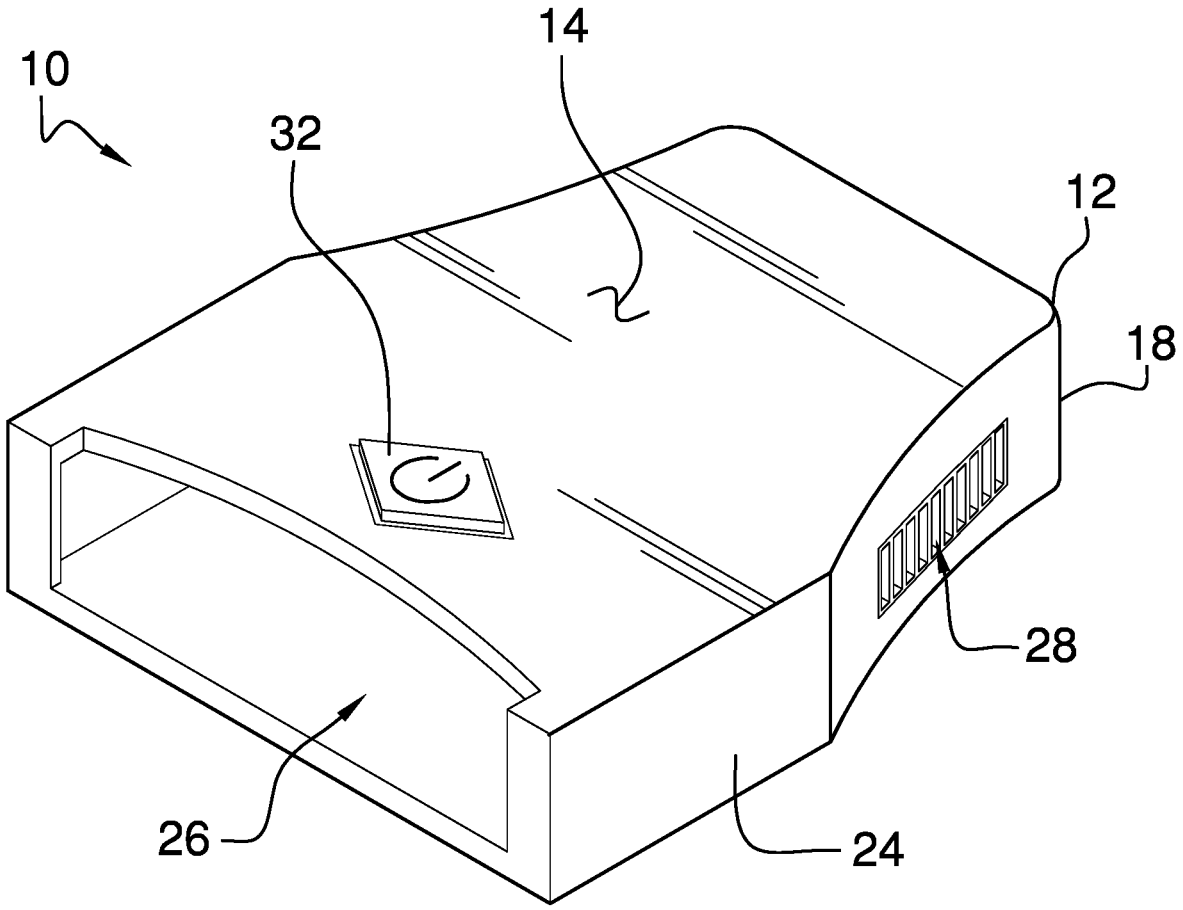
FIG. 1 is a top and front isometric view of a gel polish curing assembly according to an embodiment of the disclosure.
Figure 2:
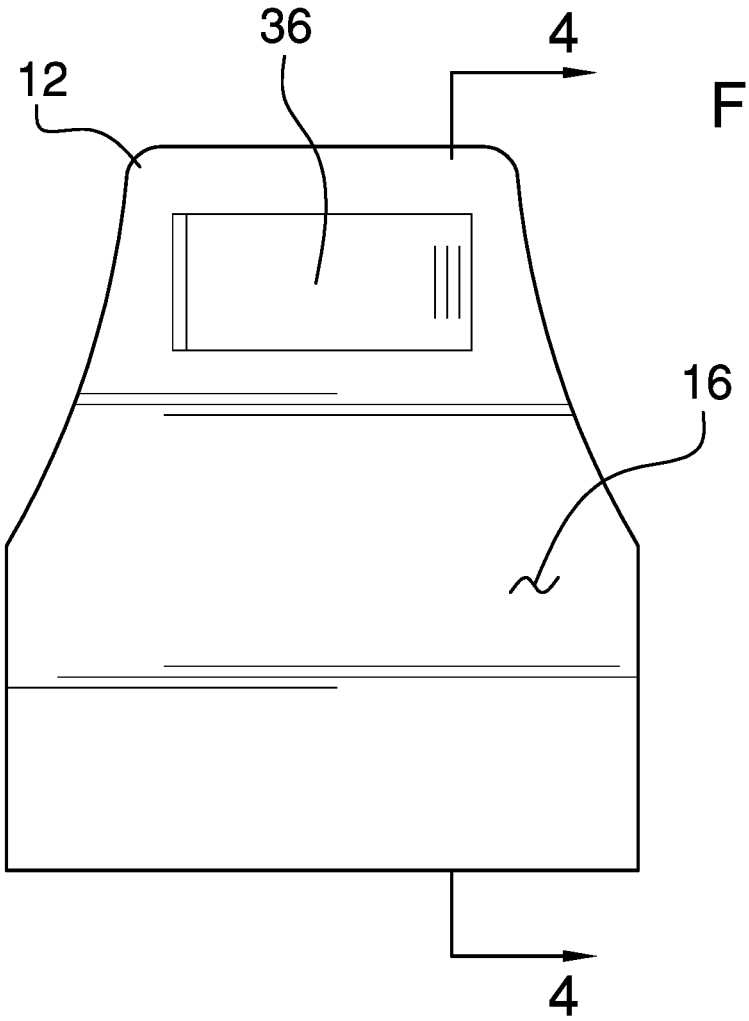
FIG. 2 is a bottom view of an embodiment of the disclosure.
Figure 3:
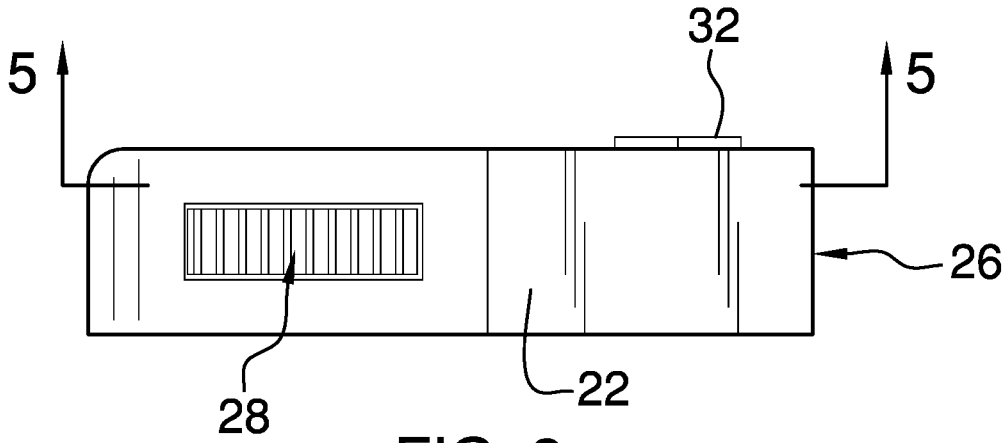
FIG. 3 is a side view of an embodiment of the disclosure.
Figure 4:
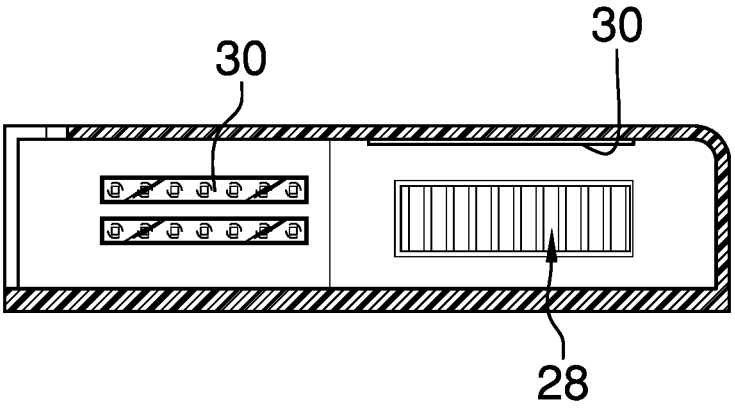
FIG. 4 is a cross-sectional view of an embodiment of the disclosure taken along line 4-4 of FIG. 2.
Figure 5:
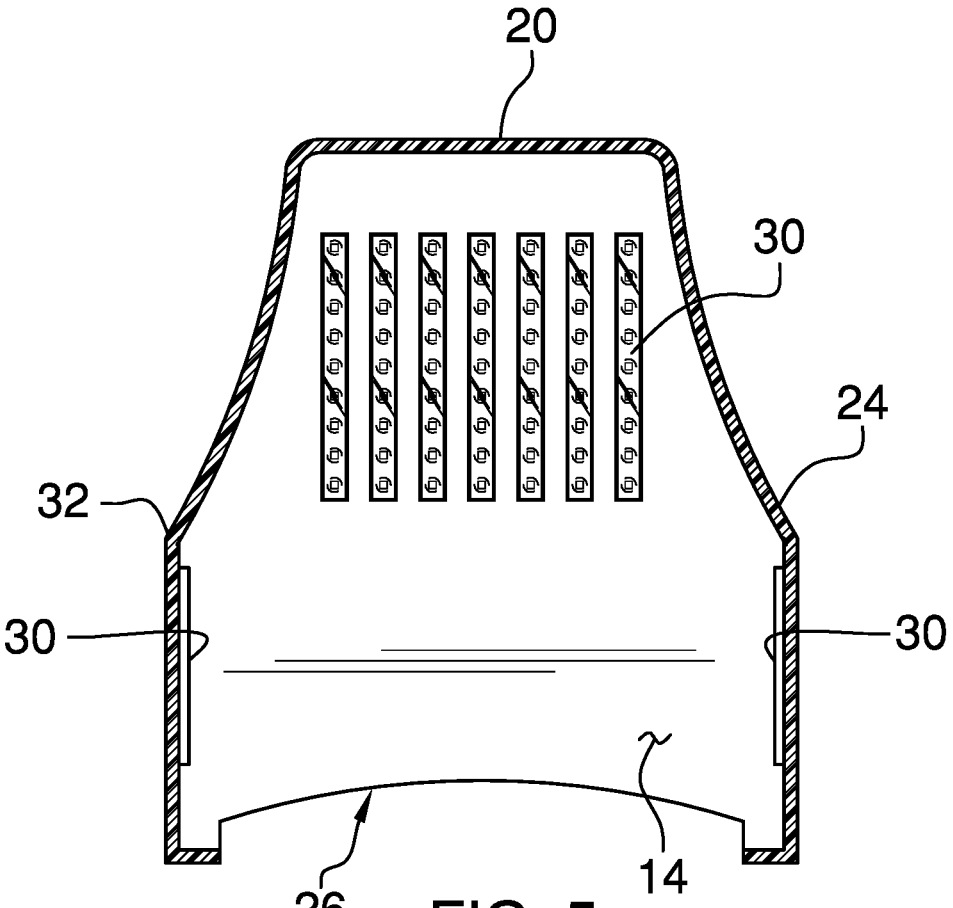
FIG. 5 is a cross-sectional view of an embodiment of the disclosure taken along line 5-5 of FIG. 3.
Figure 6:
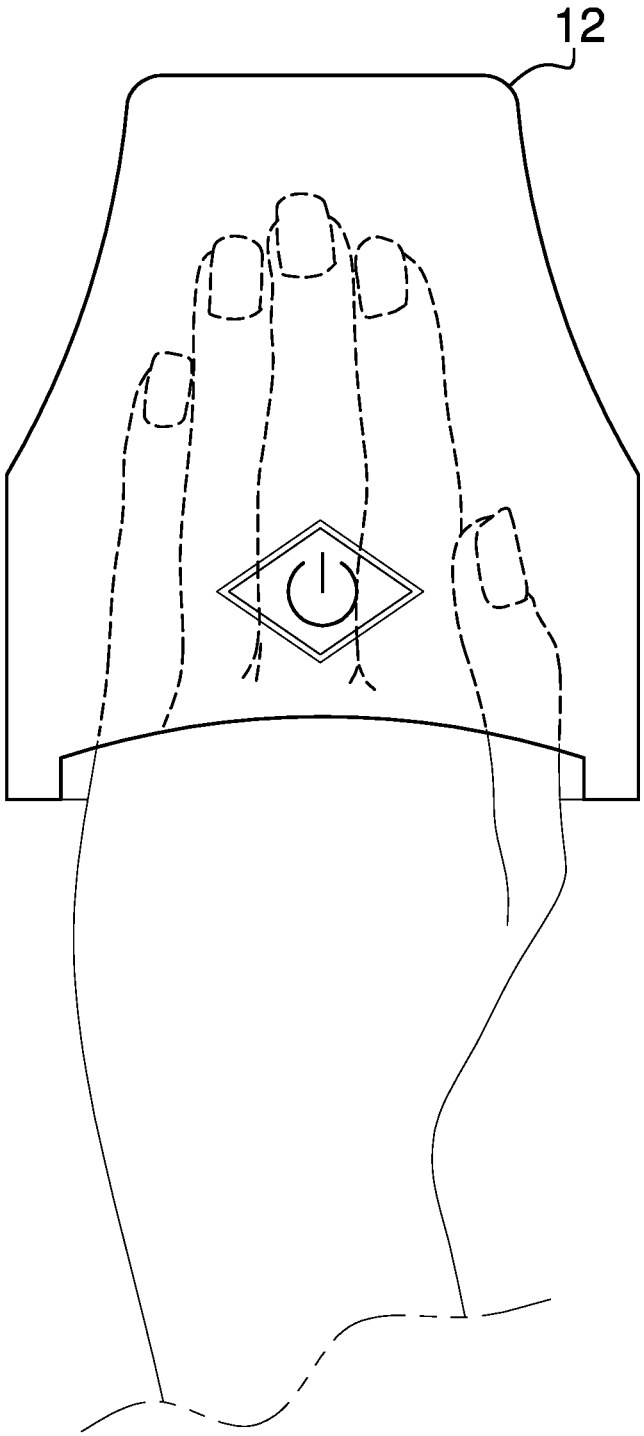
FIG. 6 is a top in-use view of an embodiment of the disclosure.
Figure 7:
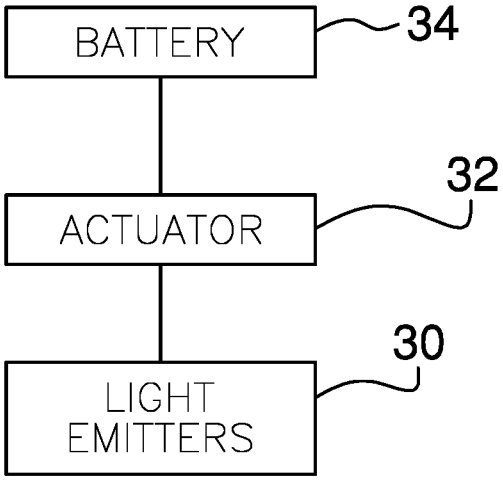
FIG. 7 is a schematic view of an embodiment of the disclosure.

With reference now to the drawings, and in particular to FIGS. 1 through 7 thereof, a new polish curing device embodying the principles and concepts of an embodiment of the disclosure and generally designated by the reference numeral 10 will be described.

As best illustrated in FIGS. 1 through 7, the gel polish curing assembly 10 generally comprises a housing 12 that has a top wall 14, a bottom wall 16 and a perimeter wall 18 extending between the top 14 and bottom 16 walls. The perimeter wall 16 includes a back wall 20, a first lateral wall 22 and a second lateral wall 24. A front side 26 of the housing 12 is open. The front side 26 has a width between 3.5 inches and 5.0 inches. The housing 12 has a height between 0.75 inches and 1.5 inches and a depth from the front side 26 to the back wall 20 is between 3.0 inches and 6.0 inches.

The first 22 and second 24 lateral walls each have a plurality of vent openings 28 extending therethrough. The vent openings 28 are positioned nearer to the back wall 20 than the front side 26. The housing 12 may have shape that tapers inward toward the back wall 20.

A plurality of light emitters 30 is mounted within the housing 12. At least some of the light emitters 30 and is positioned on a bottom side of the top wall 14 and is directed downwardly toward the bottom wall 16. The light emitters 30 emit light having a wavelength between 340 and 380 nanometers. At least some of the light emitters 30 is mounted on the first lateral wall 22 and positioned adjacent to the front side 26. At least some of the light emitters 30 is mounted on the second lateral wall 24 and positioned adjacent to the front side 26. The light emitters 30 on the first 22 and second 24 lateral walls are positioned to ensure gel positioned on thumbnails are readily struck with light. Typically the light emitters 30 are comprised of light emitting diodes.

An actuator 32 is mounted on the housing 12 and is electrically coupled to the light emitters 30. The actuator 32 is actuated to turn the light emitters 30 on or off. A battery 34 is mounted in the housing 12 and is electrically coupled to the light emitters 30. The battery 34 is accessible through a battery door 36 positioned on the housing 12.

In use, after a person has gel polish positioned on their fingers, the gel may be cured using UV light in the 340 to 380 nanometer range. The assembly 10 receives the person's hand to simultaneously cure the gel on all of the fingernails. The assembly 10 may include a timer such that the light emitters 30 are turned off after a time period of between 30 seconds and 90 seconds.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gel polish curing assembly comprising:

a housing having a top wall, a bottom wall and a perimeter wall extending between said top and bottom walls, said perimeter wall including a back wall, a first lateral wall and a second lateral wall, a front side of said. housing being open;

a plurality of light emitters being mounted within said housing, at least some of said light emitters being positioned on a bottom side of said top wall and being directed downwardly toward said bottom wall, said light emitters emitting light having a wavelength between 340 and 380 nanometers; and wherein said front side has a width between 3.5 inches and 5.0 inches, said. housing having a height between 0.75 inches and 1.5 inches, said housing having a depth from said front side to said back wall being between 3.0 inches and 6.0 inches.

2. The gel polish curing assembly according to claim 1, wherein said first and second lateral walls have a plurality of vent openings extending therethrough.

3. The gel polish curing assembly according to claim 2, wherein said vent openings are positioned nearer to said back wall than said front side.

4. The gel polish curing assembly according to claim 1, wherein at least some of said light emitters is mounted on said first lateral wall and positioned adjacent to said front side, at least some of said light emitters being mounted on said second lateral wall and positioned adjacent to said front side.

5. The gel polish curing assembly according to claim 1, wherein said light emitters comprise light emitting diodes.

6. The gel polish curing assembly according to claim 1, further including:

an actuator being mounted on said housing and being electrically coupled to said light emitters, said actuator being actuated to turn said light emitters on or off; and a battery being mounted in said housing and being electrically coupled to said light emitters.

7. A gel polish curing assembly comprising:

a housing having a top wall, a bottom wall and a perimeter wall extending between said top and bottom walls, said perimeter wall including a back wall, a first lateral wall and a second lateral wall, a front side of said housing being open, said front. side having a width between 3.5 inches and 5.0 inches, said housing having a height between 0.75 inches and 1.5 inches, said housing having a depth from said front side to said back wall being between 3.0 inches and 6.0 inches;

said first and second lateral walls having a plurality of vent openings extending therethrough, said vent openings being positioned nearer to said back wall than said front side;

a plurality of light emitters being mounted within said housing, at least some of said light emitters and being positioned on a bottom side of said top wall and being directed downwardly toward said bottom wall, said light emitters emitting light having a wavelength. between 340 and 380 nanometers, at least some of said light emitters being mounted on said first lateral wall and positioned adjacent to said front side, at least some of said light emitters being mounted on said second lateral wall and positioned adjacent to said front side, said light emitters comprising light emitting diodes;

an actuator being mounted on said housing and being electrically coupled to said light emitters, said actuator being actuated to turn said light emitters on or off; and a battery being mounted in said housing and being electrically coupled to said light emitters.

* * * * *